United States Patent [19]

Essmann et al.

[11] 4,288,318

[45] Sep. 8, 1981

[54] PNEUMATIC SEPARATOR FOR FLOWABLE PARTICULATE MATERIALS

[75] Inventors: Wolfgang Essmann; Kurt Schnellbacher, both of Brunswick, Fed. Rep. of Germany

[73] Assignee: Bühler-Miag GmbH, Brunswick, Fed. Rep. of Germany

[21] Appl. No.: 166,457

[22] Filed: Jul. 7, 1980

[30] Foreign Application Priority Data

Jul. 21, 1979 [DE] Fed. Rep. of Germany ..... 2929672

[51] Int. Cl.[3] ..... B07B 4/02

[52] U.S. Cl. ..... 209/139 R; 209/150

[58] Field of Search ..... 209/138, 139 R, 139 A, 209/142, 146, 150

[56] References Cited

U.S. PATENT DOCUMENTS

| | | | |
|---|---|---|---|
| 1,914,862 | 6/1933 | Menk | 209/150 |
| 1,987,615 | 1/1935 | Fraser | 209/139 A |
| 3,036,708 | 5/1962 | Freeman | 209/146 X |
| 3,524,544 | 8/1970 | Jäger | 209/139 R |
| 4,058,455 | 11/1977 | Schier | 209/139 R |

FOREIGN PATENT DOCUMENTS

| | | | |
|---|---|---|---|
| 2958281 | 1/1916 | Fed. Rep. of Germany | 209/139 R |

*Primary Examiner*—William A. Cuchlinski, Jr.
*Attorney, Agent, or Firm*—Michael J. Striker

[57] ABSTRACT

A device for separating multi-fraction particulate materials includes a housing with an inner passage for admitting the material to be processed and an outer passage having an outlet and connected to a suction device for producing an air stream in an upward direction. A guide body with a conical surface and a shoulder having an edge are mounted in the housing. The second passage has in the region below the shoulder a zig-zag shaped passage portion. The incoming stream of mixture falls on the conical surface, then on the edge of the shoulder and then is discharged into the zig-zag shaped portion so that when suction is applied to the outlet of the outer passage the material undergoes repeated directional changes during each of which the air stream travels transversely through the material.

8 Claims, 2 Drawing Figures

PNEUMATIC SEPARATOR FOR FLOWABLE PARTICULATE MATERIALS

BACKGROUND OF THE INVENTION

The present invention relates to a pneumatic separator for flowable particulate materials, e.g., chaff from grain.

Pneumatic separators for this purpose are already known. For example, German Pat. DE No. 1,131,491 discloses a pneumatic separator in which a cylindrical housing surrounds a tubular separating channel the inner wall of which forms a container that is closed at the top and open at the bottom. Beneath this container and coaxially therewith, there is arranged a distributor body having a central passage and a conical guide face. An annular gap is provided between the body and the container for entry of the material into the separating channel. A central duct terminates beneath and at a distance from the body; the material to be processed is blown via compressed air through the central passage into the container and at the same time some of the air is branched off beneath the distributor body to enter laterally into the separating channel. A tube nipple concentrically surrounds the outlet end of the duct and conically diverges towards the distributor body; its inlet end communicates with the atmosphere and its outlet end, through which additional air is supplied into the separating channel, is shielded against the entry of material leaving the channel.

An analogous separator is disclosed in German Pat. DE No. 1,507,715. Here, the container arranged in the housing is of frustoconical shape, so that the separating channel converges in the flow direction of the separating air stream. An annular step is provided on the conical guide face of the distributor body to achieve a brief retardation of the particulate material, the aim being to assure that it enters into the separating channel in a constant flow and substantially uniformly distributed over the periphery of the body.

According to a proposal in German Gebrauchsmuster DE-GM No. 6,910,093 the material is supplied via a separate duct entering the container in the housing. Housing parts contacted by the material are provided with arrangements for cleaning them via airstreams, to prevent agglomeration of the material on these parts.

Finally, separators are known in which material is admitted from above via a central supply tube and the conical distributor body arranged under the outlet end of the tube can be moved relative to the tube counter to the action of an energy-storing device, so that it opens the outlet of the tube to a greater or lesser extent in dependence upon the weight of the column of incoming material acting upon it (U.S. Pat. No. 1,987,615 and British Pat. No. 715,176).

These prior-art devices are employed in a variety of applications, for example to separate chaff from grain, dust from grain and malt, substandard (shrivelled) kernels from acceptable ones, to clean and segregate granulates by fractions, and the like. In many of these applications the prior-art devices operate satisfactorily. However, when materials are involved which are difficult to separate pneumatically, such as e.g., dehusked cereals, it has been found in practice that they will produce only very limited results. Also, these devices are at least in some instances rather complicated and therefore also expensive. Dehusked crop mixtures of grains and legumes, e.g., oats, rice, soy beans, peas and the like, are difficult to separate because the kernels (grain, beans or peas) have very different floating speeds from the husks or shells or parts thereof.

SUMMARY OF THE INVENTION

The principal object of the invention is to overcome the prior-art disadvantages.

A more particular object of the invention is to provide an improved pneumatic separator which is of simple construction and requires little maintenance and which has universal applicability.

An equally important object is to provide such an improved pneumatic separator which produces a highly effective separation of the different fractions, even when difficult-to-separate flowable (pourable) particulate materials are involved.

Pursuant to these objects, and still others which will become apparent hereafter, one aspect of the invention resides in a pneumatic separator for flowable particulate materials. Briefly stated, such a separator may comprise first means defining a first upright passage for admission of a multi-fraction particulate material and having a first open lower end; second means defining an upright annular second passage surrounding the first passage outwardly spaced therefrom and having a second open lower end downwardly spaced from said first end, the second passage having an outlet in the region of its upper end and converging in the direction towards the region; and a guide body centrally located beneath the first end and having a conical surface which directs the material towards the second end, and a shoulder extending at least substantially normal to a central axis of the annular second passage and having an edge over which material is discharged into the second channel, the second channel having at least in the region below the shoulder at least one zig-zag shaped passage portion so that, when suction is applied to the outlet and material is discharged into the passage portion, the material undergoes repeated directional changes during each of which the airstream aspirated by application of the suction travels transversely through the material.

Due to the shoulder which is inclined to the separating air stream and over which the material is discharged, components of speed counter to the flow direction of the separating (air) stream are either completely avoided or reduced to a negligible factor. The effect of this deflection of the flow of particulate material is the stronger, the heavier the particles are because the afore-mentioned speed components increase with increasing particle weight. The (in cross-section) zig-zag shaped deflecting region deflects the flow of particles repeatedly, so that the separating stream flows through it in transverse direction several times. Tests and measurements carried out under actual operating conditions have shown that the combination of these two measures results in a substantial improvement of both the quality and quantity of separation, particularly with respect to the dehusked crop mixtures which are otherwise difficult to separate because of their voluminous husk fraction. Depending upon the desired separation effect, several particle-deflecting locations may be arranged sequentially (with reference to the flow direction of the separating stream) ahead of the shoulder and one or more may also be located behind (i.e., following) the shoulder.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
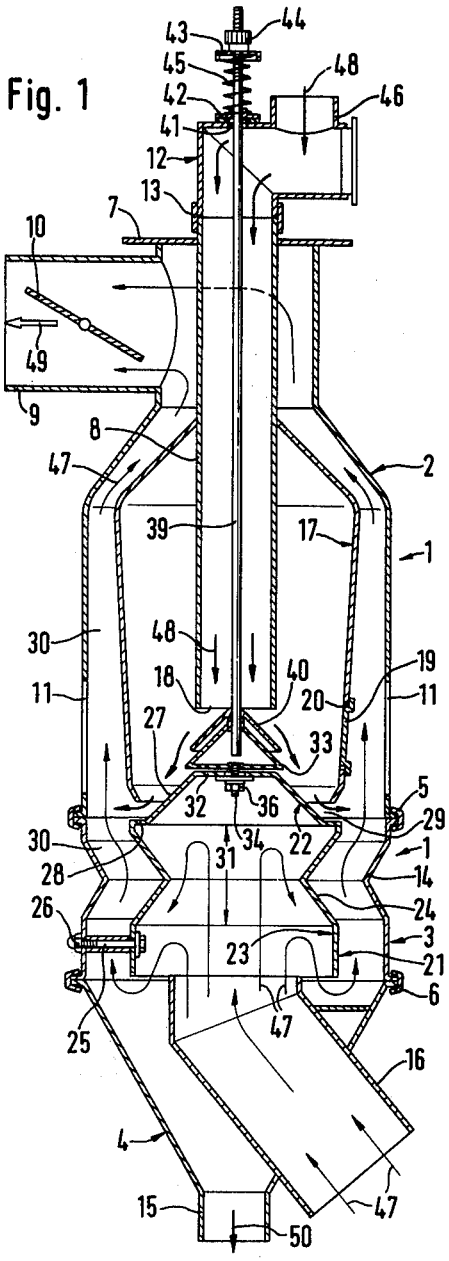
FIG. 1 is a somewhat diagrammatic vertical section through a separator embodying the invention.
Figure 2:
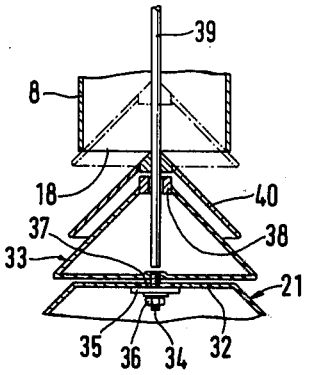
FIG. 2 is a fragmentary sectional view, showing a detail of FIG. 1 on an enlarged scale.

An exemplary embodiment of a separator according to the invention is illustrated in FIGS. 1 and 2 and is particularly, but not exclusively, suited for separating dehusked crops, e.g., oats. The separator has a housing 1 composed of an upper part 2, a center part 3 and a lower part 4. At their respective adjoining ends these parts have circumferential flanges which are straddled and pulled together by respective U-section clamping rings 5 and 6. The housing parts are thus rigidly but releasably connected with one another.

The upper part 2 is basically of cylindrical shape but its top portion converges in upward direction and is terminated at the upper end by a cover 7. A supply pipe 8 extends through and is secured to the cover 7 to enter coaxially into the housing. An outlet portion 9 on part 2 is connected via a not-illustrated cyclone separator with the suction side of not-illustrated blower which produces the separating air stream. A throttle 10 in the portion 9 permits regulation of the air flow. The lower area of part 2 is provided with two e.g., diametrally opposite windows 11 through which the flow of particulate material and the separating operation can be observed.

As will be more fully explained later on, the particulate material to be separated (e.g., a mixture of oat grain and husks) enters through port 46 in the direction of arrow 48. To compensate for the effect of different portions of the material dropping into the port 46 from different heights, a tubular elbow 12 is interposed between the port 46 and the part 2, to which latter it is connected by a clamping ring 13.

The housing part 3 is also of cylindrical shape but is provided with a zig-zag shaped internal cross-sectional constriction 14. Lower housing part 4 converges downwardly and terminates in an outlet 15 for one of the separated fractions. A suction pipe 16 extends at an angle through the part 4, as shown; where it penetrates the outer wall of part 4 it is sealingly connected to this wall. The upper end of pipe 16 is angled so as to have its outlet opening coaxial with the central vertical axis of housing 1.

A double-conical hollow body 17 is coaxially mounted in the housing 1; it surrounds the pipe 8 and its upper end is sealingly connected to the same. The circumferential wall of the body 17 has an opening 20 which is located approximately at the level of the outlet opening 18 through which the incoming particulate material leaves the pipe 8. A plate or baffle 19 is mounted in the opening 20 and can be turned therein to an open and a closed position, so that direct visual observation of the stream of incoming material is possible.

A sheet-metal material-guiding body 21 of double-conical shape is mounted in part 3, slightly downwardly spaced from the body 17. It has an upwardly convergent frustoconical section 22 and immediately below that a frustoconical shape which converges very slightly in downward direction and is provided with an inner cross-sectional constriction 24. The lower end of body 21 is open and a plurality (one shown) of circumferentially distributed bolts 25 and nuts 26 secure the body to the part 3. The conical outer surface 27 of section 22 merges radially outwardly into an annular shoulder 28 which extends approximately normal to the vertical longitudinal axis of housing 1 (and from which the particulate material to be separated runs off).

As FIG. 1 shows, the body 21 is so arranged relative to the body 17 that an annular gap is formed between their proximal ends. This gap constitutes the material entry 29 for the separating channel 30 which is bounded by the walls of housing parts 2, 3 on the one hand and the walls of body 17 and of section 23 on the other hand. In direction upwardly of the shoulder 28 the channel 30 converges and in direction downwardly from the same shoulder it diverges. The volumetric capacity of channel 30 in the zig-zag shaped deflecting region 31 is greater, by the volume of the particulate material to be separated which enters the channel 30 per unit time, than the volumetric capacity which would be needed to obtain the desired separating-air flow speed without any particulate material present in the device; related to the here assumed separation of an oat husk mixture, this volumetric excess would be about 5%.

A conical guide baffle 33 is mounted on the upper end wall 32 of body 21 by means of a bolt 34 which is welded to baffle 33 and extends through a hole 37 in end wall 37 where it is secured via a washer 35 and a nut 36. The size of hole 37 is so selected (FIG. 2) that after release of nut 36 the bolt 34 can be shifted in it in all directions, which is to say that the baffle 33 itself can be correspondingly shifted relative to the outlet 18 of pipe 8. The upper end of baffle 33 is provided with a bushing 38 (FIG. 2) which slidably accommodates a rod 39 that is adjustable up or down in (i.e., lengthwise of) the housing 1 and carries a conical closure member 40 which can be moved (by movement of rod 40) between the full-line position and the broken-line position shown in FIG. 2 (or to intermediate positions). In the broken-line position it closes the outlet 18. The rod 39 itself extends through pipe 8 and elbow 12 and projets outwardly through a hole in the wall of the latter. Its outwardly projecting endportion is surrounded by two axially spaced dished springs 42, 43 (or else just spring seats) between and bearing upon which a helical spring 45 is confined. A nut 44 is threaded onto the rod 39 and compresses the spring 45 via the element 43; this compression is so selected (by advancing the nut or backing it off) that there will always be a certain minimum quantity of particulate material present in the pipe 8 (assuming a continuing supply via port 46), to assure the infeeding of a wholly or almost completely uniform "veil" of particulate material which runs over the shoulder 28 (at the entire circmference thereof) into the channel 30.

THE OPERATION

In operation the not-illustrated blower, the suction side of which is connected with the outlet 9, draws atmospheric air through the pipe 16, as indicated by the arrows 47 in FIG. 1. A stream—the separating air stream—of this air passes out of the interior of body 21 and enters past the lower edge thereof into the lower open end of channel 30. From there it travels upwardly into the housing part 2 and then via the outlet 9 to the cyclone separator and blower.

The particulate material to be separated, e.g., a mix of husks and oats, enters in free fall via the port 46 as indicated by the arrows 48 and from there passes via elbow 12 into pipe 8 in which it travels downwardly to escape from the outlet 18, or more particularly the annular gap formed between the edge bounding outlet 18 and the surface of member 40. The size—i.e., axial length —of this gap is a function of the weight of the column of material present in pipe 8 and bearing upon member 40, to thus cause member 40 and rod 39 to move downwardly to a greater or lesser extent in accordance with the prestress of spring 45.

The material issuing from the annular gap slides over the surface 27 and in uniform circumferential distribution proceeds to the shoulder 28 from which it slides off into the channel 30. Due to the orientation of the shoulder 28 the flow directon of the material is oriented to be approximately normal to the flow direction of the separating air stream which blows now through the material and upwardly entrains the loose husks or husk fragments, to remove them via outlet 9 to the cylcone separator as one fraction (see arrow 49).

Those husks and husk fragments which are not immediatlely entrained in this manner (and also fragmented grains and shrivelled grains) drop into the deflecting region 31, together with the whole oat grains. In this region the mixture undergoes repeated direction change (deflections) and after each such change the separating air flows transversely through the mixture. During this treatmemt the remaining husks and husk fragments, grain fragments, shrivelled grains and even any lighter impurities present, are entrained and removed via outlet 9. The remaining (acceptable) grains drop out of the section 31 into the part 4, from where they flow off (see arrow 50) as the second separated fraction via the outlet 15, to enter either into a container (e.g., bag or the like) or to be removed by conveyor.

An advantage of having the section 31 below shoulder 28 conical diverge counter to the airflow direction, is that this measure improves the separating effectiveness.

The volume ratio explained earlier assures that the net volumetric capacity of the channel section 31 cannot be reduced by the inflowing material and that optimum flow conditions are maintained for the separation.

The use of element 40 is particularly advantageous to permit compensation for possible tolerance variations in the manufacture. For example, by lateral shifting of the element 40 the cross-section of the annular gap through which the material to be separated issues, can be made uniform over the entire gap circumference, so as to obtain a uniform outflow of material which is one of the prerequisites for proper operation.

Having the body 21 be open downwardly and the suction pipe terminate in it, has the advantage that a preliminary resistance is formed in simple manner which is needed to assure uniform air distribution over the cross-section of channel 30 and cause a dual change in direction of airstream. In turn, this causes the stream of air to intercept and slow down the flow of particulate material and guarantees intensive separation action. By extending or shortenting the part of the suction pipe 16 which extends into the body 21, the preliminary resistance can be increased or decreased, respectively.

It is self-evident that a gas other than air could be aspirated through pipe 16, although generally air will be preferred as being most practical and/or least costly.

While the invention has been illustrated and described as embodied in a pneumatic separator for grain and legume crops, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A pneumatic separator for multi-fraction particulate pourable materials, comprising first means defining a first upright passage for admission of a multi-fraction particulate material in downward direction and having a first open lower end; second means defining an upright annular second passage surrounding said first passage outwardly spaced therefrom and having a second open lower end downwardly spaced from said first end, said second passage having an outlet in the region of its upper end and converging in the direction towards said region; means for applying suction to said outlet to produce in said second passage an airstream flowing in upward directon and a guide body centrally located beneath said first end and having a conical surface which directs the material towards said second end, and a shoulder downwardly of said conical surface and extending at least substantially normal to a central axis of said annular second passage and having an edge over which material is discharged into said second passage in direction substantially normal to said airstream and without having at the time of such discharge any significant componenet of movement in said downward direction, said second passage having at least in the region below said shoulder at least one zig-zag shaped passage portion so that, when suction is applied to said outlet and material is discharged into said passage portion, the material undergoes repeated directional changes during each of which the airstream aspirated by application of the suction travels transversely through the material.

2. A pneumatic separator as defined in claim 1, said outlet constituting an outlet for a separated first fraction of the material; and further comprising a discharge part downwardly spaced from said body and constituting an outlet for a separated second fraction of the material.

3. A pneumatic separator as defined in claim 1, wherein said passage portion diverges conically in direction counter to the flow of the aspirated airstream.

4. A pneumatic separator as defined in claim 1, said passage portion having a volumetric capacity which is larger by the volume of material entering thereinto per unit time than said passage portion requires to permit therethrough a predetermined airflow speed in the absence of such material.

5. A pneumatic separator as defined in claim 1; and further comprising means for opening and closing said first lower end.

6. A pneumatic separator as defined in claim 5, said opening and closing means comprising a conical closure member movable axially towards and away from said first lower end.

7. A pneumatic separator for multi-fraction particulate pourable materials, comprising first means defining a first upright passage for admission of a multi-fraction particulate material and having a first open lower end; second means defining an upright annular second passage surrounding said first passage outwardly spaced therefrom and having a second open lower end downwardly spaced from said first end, said second passage having an outlet in the region of its upper end and converging in the direction towards said region; a downwardly open hollow guide body centrally located beneath said first end and having a conical surface which directs the material towards said second end, and a shoulder extending at least substantially normal to a central axis of said annular second passage and having an edge over which material is discharged into said second channel, said second channel having at least in the region below said shoulder at least one zig-zag shaped passage portion so that, when suction is applied to said outlet and material is discharged into said passage portion, the material undergoes repeated directional changes during each of which the airstream aspirated by application of the suction travels transversely through the material; and a suction conduit communicating with the ambient atmosphere and having an inner discharge end communicating with the interior of said body.

8. A pneumatic separator for multi-fraction particulate pourable materials, comprising first means defining a first upright passage for admission of a multi-fraction particulate material and having a first open lower end; second means defining an upright annular second passage surrounding said first passage outwardly spaced therefrom and having a second open lower end lownwardly spaced from said first end, said second passage having an outlet in the region of its upper end and converging in the direction towards said region; a guide body centrally located beneath said first end and having a concial surface which directs the material towards said second end, and a shoulder extending at least substantially normal to a central axis of said annular second passage and having an edge over which material is dischared into said second channel, said second channel having at least in the region below said shoulder at least one zig-zag shaped passage portion so that, when suction is applied to said outlet and material is discharged into said passage portion, the material undergoes repeated directional changes during each of which the airstream aspirated by application of the suction travels transversely through the material; and means for opening and closing said first lower end, including a conical closure member movable axially towards and away from said first lower end; a conical guide member nested in said closure member, and means connecting said guide member to said body with freedom of displacement in direction transverse to the elongation of said first passage.

* * * * *